United States Patent [19]

George et al.

[11] 3,969,964

[45] July 20, 1976

[54] HAND TOOL FOR HOLDING AN ELONGATED MEMBER WHILE SIMULTANEOUSLY MOVING A SECOND MEMBER AXIALLY ALONG THE ELONGATED MEMBER

[76] Inventors: Douglas Franklin George, 324 Jefferson St., Bakersfield, Calif. 93305; Wayne Lester Yowell, 3729 Ethyl St., Bakersfield, Calif. 93308

[22] Filed: Sept. 2, 1975

[21] Appl. No.: 609,585

[52] U.S. Cl. ..... 81/310; 81/5.1 R; 29/268

[51] Int. Cl.[2] ..... B25B 7/02

[58] Field of Search ..... 81/303, 307, 308, 310, 81/5.1 R, 3 CP; 29/239, 244, 248, 268

[56] References Cited

UNITED STATES PATENTS 3,130,484 4/1964 Zdanis ..... 81/303

*Primary Examiner*—Al Lawrence Smith
*Assistant Examiner*—Roscoe V. Parker

[57] ABSTRACT

First and second work-engaging members grip an elongated member normal to its major axis while a third work-engaging member moves an element axially along the elongated member. The first and second work-engaging members are on first and second levers which rotate in a first plane and the third work-engaging member is on a lever pivotally connected to the first and second levers for rotation in a second plane substantially normal to the first plane.

10 Claims, 3 Drawing Figures

HAND TOOL FOR HOLDING AN ELONGATED MEMBER WHILE SIMULTANEOUSLY MOVING A SECOND MEMBER AXIALLY ALONG THE ELONGATED MEMBER

BACKGROUND OF THE INVENTION:

The background of the invention will be set forth in two parts.

FIELD OF THE INVENTION

The present invention pertains generally to the field of hand tools and more particularly to a new and useful hand tool especially designed for gripping an elongated member while simultaneously moving a second member axially along the elongated member.

DESCRIPTION OF THE PRIOR ART

Caliper-type brakes on vehicles such as bicycles include a pair of brake arms having first ends carrying brake pads and second ends connected to a yoke cable. A cable clamp connects the yoke cable to a brake-actuating cable which may be pulled to swing the brake pads into engagement with the rim on one of the vehicle's wheels. Torsion springs bias the brake arms to an open position. It is desirable to set the cable clamp in a position on the brake-actuating cable such that the yoke cable pulls the brake arms enough to partially overcome the force of the torsion springs, thereby positioning the brake pads closely adjacent the rim of the wheel. This minimizes the amount the brake-actuating cable must travel to bring the brake pads into gripping engagement with the rim.

Moving the cable clamp axially along the brake-actuating cable against the force exerted by the torsion springs has been a problem.

One prior art tool designed to facilitate adjusting the cable clamp is a clamping tool which may be clamped onto the brake pads to hold them in engagement with the rim while the cable clamp is being repositioned. An example of this prior art tool is shown as Item No. 12 at page 879 of the Fall and Winter 1975 Montgomery Ward catalog.

One difficulty with this prior art tool resides in the fact that the brake pads may not have sufficient clearance with respect to the rim after the cable clamp has been moved axially along the brake-actuating cable the full distance permitted by the set brake pads. If, on the other hand, the cable clamp is moved less than this full distance, the brake pads may move too far away from the rim when the tool is removed. Another difficulty resides in the fact that it is still unhandy to hold the brake-actuating cable while simultaneously moving the cable clamp.

Another prior art device designed to facilitate adjusting the cable clamp is a U-shaped tool having arms which are naturally sprung to predetermined open positions. The free end of one arm carries a clip on which an overthrow lever is rotatably mounted. The clip may be engaged around the brake-actuating cable and the overthrow lever may then be swung to clamp the cables against the clip along the major axis of the cable. The free end of the other arm carries a lip having a notch provided on its leading edge. The arms may be squeezed toward each other enough to admit the lip under the cable clamp with the notch straddling the cable. The arms may then be released so that their natural resiliency holds the brake-actuating cable under even tension when adjusting the brakes. An example of a U-shaped tool of this type is shown as Item No. 11 at page 879 of the Fall and Winter 1975 Montgomery Ward catalog.

One difficulty with this U-shaped tool resides in the fact that it is still necessary to clamp the brake pads against the rim in order for the U-shaped tool to be effective in adjusting the cable clamp. Another difficulty resides in the fact that the overthrow lever limits the amount the arms can be brought together, thereby requiring more working space than that which may be available. Yet another difficulty resides in the fact that the overthrow lever may fray the brake-actuating cable.

SUMMARY OF THE INVENTION

In view of the foregoing factors and conditions characteristic of prior art tools of the type discussed, it is a primary object of the present invention to provide a new and useful tool not subject to the difficulties enumerated above and having apparatus especially designed for holding an elongated member while moving a second member axially along the elongated member efficiently and expeditiously.

According to the present invention, a hand tool is provided for holding an elongated member while simultaneously moving a second member axially along the elongated member. The tool may be advantageously used to adjust caliper-type brakes on bicycles and includes apparatus for gripping the free end of the brake-actuating cable normal to its major axis and a lever pivotally connected to the apparatus for engaging the cable clamp and moving it axially along the brake-actuating cable against the bias of the torsion springs urging the brake arms to a position where the brake pads are spaced from the rim of the bicycle wheel. The lever is rotatable in a plane normal to the plane in which the gripping apparatus exerts its gripping force.

The gripping apparatus may advantageously comprise an ordinary pair of pliers to which the lever is rotatably connected by a bracket having a lower end affixed to the bolt-and-nut assembly which connects the pliers together and an upper end pinned to the lever.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which like reference numerals refer to like elements in the several views.

DESCRIPTION OF THE PREFERRED EMBODIMENT

Figure 1:
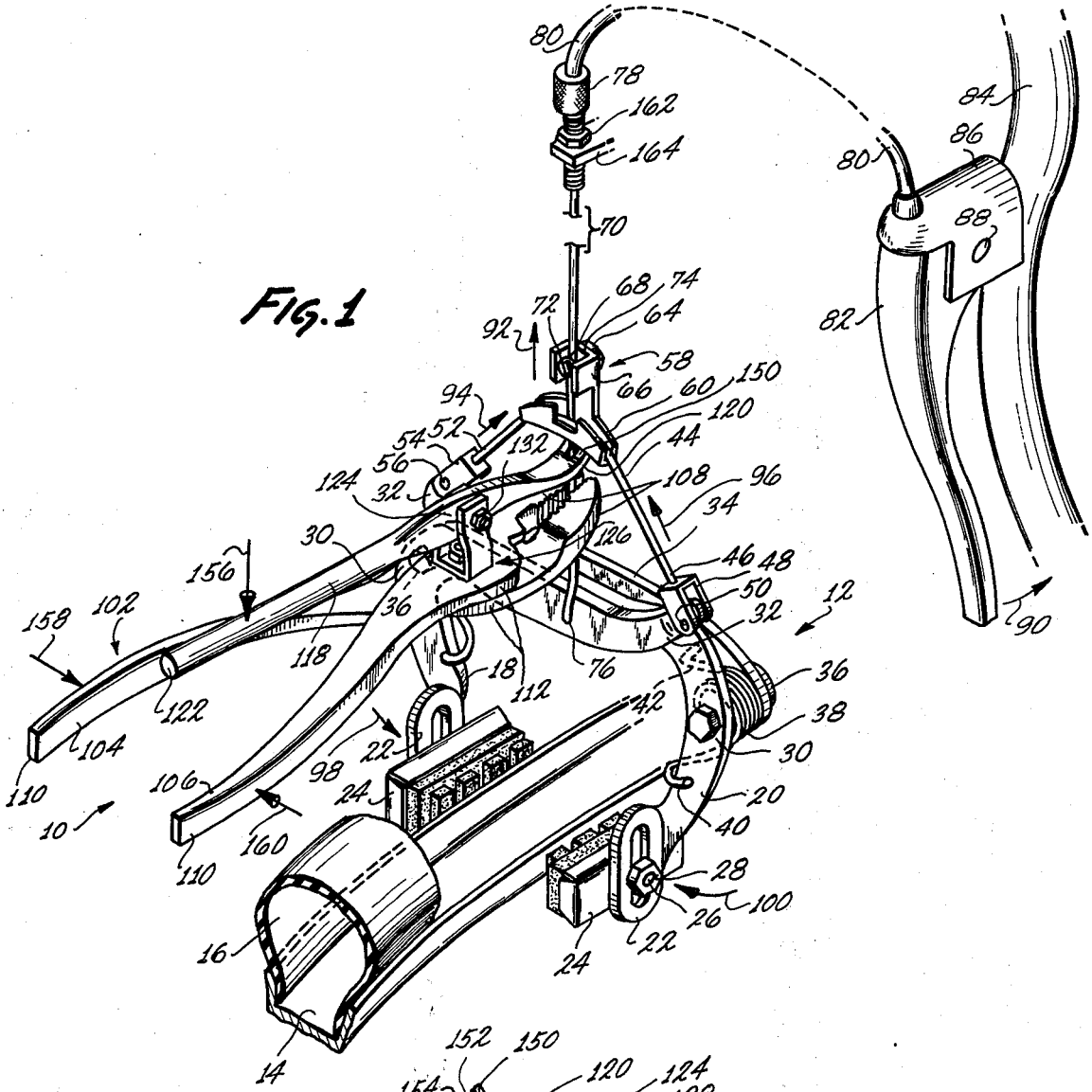
FIG. 1 is a perspective view showing a hand tool constituting a presently-preferred embodiment of the invention in position on a caliper-type brake.

Referring again to the drawing, and more particularly to FIG. 1, a hand tool constituting a presently-preferred embodiment of the invention, generally designated 10, may be advantageously used to adjust a caliper brake 12 of the type commonly used to grip a rim 14 below a tire 16 on a bicycle wheel (not shown).

Brake 12 includes a pair of brake arms 18, 20 each having a lower end 22 to which a brake pad 24 may be adjustably connected by a bolt 26 and a nut 28. Each brake arm also has an intermediate portion 30 and an upper end 32. The intermediate portions 30 are rotatably connected to a fixed bracket 34 by a suitable bolt-and-nut assembly 36 about which a torsion spring 38 is coiled. Spring 38 includes a lower end 40 which is connected to the lower end 22 of its associated brake arm 18, 20, and an upper end 42, which is connected to bracket 34, whereby springs 38 will bias arms 18, 20 outwardly away from rim 14.

Brake 12 also includes a yoke cable 44 having a first end 46 connected to the upper end 32 of brake arm 18 by a clevis 48 and a pin 50. Yoke cable 44 has a second end 52 connected to the upper end 32 of brake arm 22 by a clevis 54 and pin 56.

Brake 12 also includes a cable clamp 58 having an arcuate channel 60 provided at its lower end 62 and a cable clamp bolt 64 provided at its upper end 66. Bolt 64 is provided with a transverse bore 68 through which a brake-actuating cable 70 extends. A set screw 72 is threadedly engaged in the end 74 of cable clamp bolt 64 for clamping brake-actuating cable 72 to cable clamp 58.

Brake-actuating cable 70 includes a free end 76 extending downwardly below bracket 58 to a position between yoke cable 44 and brake arms 18, 20. Cable 70 extends upwardly through an adjusting barrel 78 and a sheath 80 to a brake lever 82 rotatably mounted on a handlebar 84 by a bracket 86 and a pin 88. When lever 82 is swung about pin 88 in the direction of arrow 90, cable 70 pulls cable clamp 58 upwardly in the direction of arrow 92. This pulls end 52 of yoke cable 44 upwardly and inwardly in the direction of arrow 94 and end 46 upwardly and inwardly in the direction of arrow 96 for pivoting brake arms 18, 20 about their bolt-and-nut assemblies 36 in the direction of arrows 98, 100, respectively overcoming the outward bias of springs 38 and causing brake pads 24 to be drawn into engagement with rim 14. Since lever 82 travels but a short distance, and since springs 38 would normally bias ends 22 of brake arms 18, 20 a greater distance than lever 82 can overcome, cable clamp 58 must be moved axially upwardly along cable 70 against the force exerted by springs 38 a sufficient distance to draw brake pads 24 inwardly in the direction of arrows 98, 100, respectively, sufficiently to give lever 82 an effective stroke. Set screws 72 may then be tightened against cable 70 to normally hold pads 24 closely adjacent rim 14 against the force exerted by springs 38. Brake 12 is then suitably adjusted. It has been rather difficult, using prior art tools and methods, for a person working alone to properly adjust cable clamp 58 with respect to cable 70 against the force exerted by springs 38. If a clamp is used to clamp brake pads 24 against rim 14 to overcome this force, then pads 24 may normally drag on rim 14. Hand tool 10, on the other hand, permits a person working alone to grip free end 76 of cable 70, sometimes referred to hereinafter as an "elongated member," normal to its major axis while simulataneously moving cable clamp 58, sometimes referred to hereinafter as a "second member," axially upwardly along elongated member 70 against the force exerted by springs 38 while leaving one hand free to manipulate set screws 72.

Figure 2:
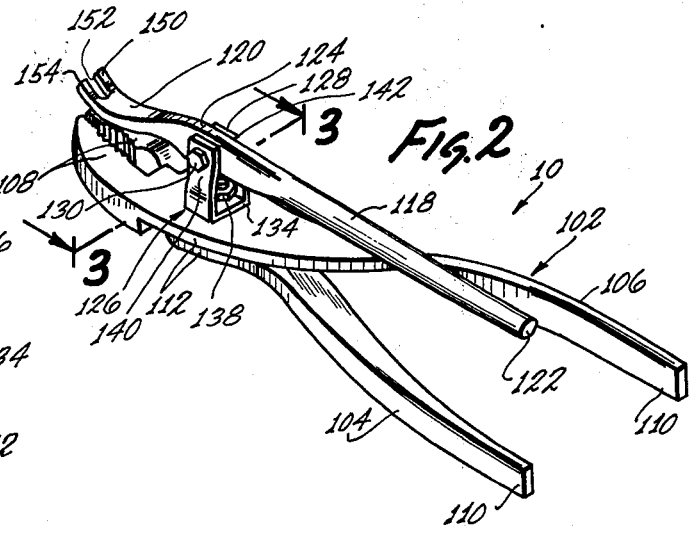
FIG. 2 is another perspective view of the hand tool of FIG. 1 showing the side of the tool which is not visible in FIG. 1.
Figure 3:
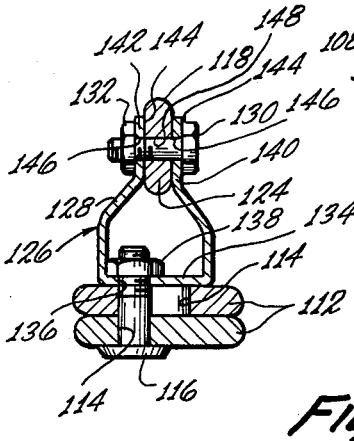
FIG. 3 is an enlarged, partial cross-sectional view taken along line 3—3 of FIG. 2.

Referring now to FIGS. 1–3, hand tool 10 includes a suitable apparatus 102 for gripping elongated member 70 normal to its major axis. Apparatus 102 is shown herein for purposes of illustration, but not of limitation, as comprising an ordinary pair of pliers having first and second levers 104, 106 each including a work-engaging end 108, a grip portion 110 and an intermediate portion 112. Each intermediate portion 112 is provided with a suitable aperture 114 (FIG. 3) receiving a bolt 116 for pivotally connecting levers 104, 106 together.

Hand tool 10 also includes a suitable device for engaging the second member or cable clamp 58 and moving it axially along elongated member 70 by pivoting in a plane normal to the plane in which apparatus 102 exerts its gripping force. This device is shown herein for purposes of illustration, but not of limitation, as comprising a third lever 118 having a work-engaging end 120, a grip portion 122 and an intermediate portion 124.

The third lever 118 may be rotatably connected to apparatus 102 for movement or rotation in a plane normal to the plane in which apparatus 102 exerts its gripping force by a suitable connector 126 shown herein for purposes of illustration, but not of limitation, as comprising a bracket 128, a bolt 130 and a nut 132. Bracket 128 may be of a U-shaped design including a bight portion 134 provided with an aperture 136 (FIG. 3) for securing bracket 128 to bolt 116 on levers 104, 106 by a suitable nut 138. Bracket 128 also includes a pair of upstanding arms 140, 142 each having an upper end 144 provided with an aperture 146 receiving bolt 130 which also passes through an aperture 148 provided in the intermediate portion 124 of the third lever 118. Thus, the third lever 118 is rotatably mounted above levers 104, 106 between upstanding arms 140, 142.

The work-engaging end 120 of lever 118 may be provided with a lip 150 having a suitable notch 152 provided in its leading edge 154. As shown in FIG. 1, notch 152 is adapted to straddle elongated member 70 so that lip 150 will extend to a position beneath cable clamp 58 for engagement therewith when lever 118 is swung in the direction of arrow 156 by the thumb (not shown) of a user of tool 10 while levers 104, 106 are simultaneously drawn in the direction of arrows 158, 160, respectively, by the fingers and palm (not shown) of the same hand of the user. Thus, the user may use one hand to simultaneously grip elongated member 70 normal to its major axis and move cable clamp 58 upwardly axially along elongated member 70 against the force exerted by springs 38. Tool 10 gives the user sufficient mechanical advantage to accurately position pads 24 closely adjacent rim 14. Although brake 12 will then be accurately adjusted, a slight amount of slack may exist between free end 76 of cable 70 and handle 82. This slack will manifest itself the first time lever 82 is actuated and may be compensated for by manipulating adjusting barrel 78 to reposition sheath 80 and cable 70. Adjusting barrel 78 may be held in this adjusted position by a cinch nut 162 which may be bottomed-out against a bracket 164 which rotatably supports adjusting barrel 78.

The operation of tool 10 is believed to be apparent and will be briefly summarized at this point. Brake 12 may be adjusted by gripping free end 76 of cable 70 between the work-engaging portions 108 of levers 104,

106 by squeezing them together in the direction of arrows 158, 160 with the palm and fingers of a user of tool 10 while the thumb of the user simultaneously exerts a downward force, in the direction of arrow 156, on the grip portion 122 of lever 118.

A screwdriver (not shown) in the other hand of the user may then be employed to loosen set screw 72 freeing cable clamp 58 for axial movement along cable 70. By maintaining a steady grip on levers 104, 106 to hold free end 76 of cable 70 stationary, the thumb of the user may then exert sufficient force downwardly on grip portion 122 of lever 118 to move cable clamp 58 upwardly in the direction of arrow 92 so that the ends 46, 52 of yoke cable 44 will be drawn upwardly and inwardly in the direction of arrows 96, 94, respectively, against the bias of springs 38 until pads 24 are closely adjacent rim 14.

Lever 118 and connector assembly 126 may be made from any suitable materials, such as metal, plastic and the like. For example, lever 118 could be injection molded from a tough polymeric material. Bolt 130 and nut 132 could be replaced by a pair of trunnions formed integrally with lever 118. It may be possible to employ bracket 128 as an insert in a mold in such a manner that the trunnions would become pivotally connected to bracket 128 during the molding operation.

While the particular hand tool herein shown and described in detail is fully capable of attaining the objects and providing the advantages hereinbefore stated, it is to be understood that it is merely illustrative of the presently-preferred embodiment of the invention and that no limitations are intended to the details of construction or design herein shown other than as defined in the appended claims, which form a part of this disclosure.

Whenever the term "means" is employed in these claims, this term is to be interpreted as defining the corresponding structure illustrated and described in this specification or the equivalent of the same.

What is claimed is:

1. A hand tool for holding an elongated member while simultaneously moving a second member axially along said elongated member, comprising:

means for gripping said elongated member normal to its major axis;

means for engaging said second member and moving it along said elongated member; and means connecting said second-mentioned means to said first-mentioned means for movement in a plane normal to the plane in which said first-mentioned means exerts its gripping force.

2. A hand tool as stated in claim 1 wherein said elongated member is a brake-actuating cable for a caliper-type bicycle brake and wherein said second member is the cable clamp which carries the yoke cable for said brake.

3. A hand tool as stated in claim 1 wherein said first-mentioned means includes:

first and second levers each having a work-engaging portion at one and a grip portion at the other end; and a bolt pivotally connecting said levers together intermediate said ends, whereby said grip portions may be brought together so that said work-engaging portions will grip said elongated member normal to its major axis.

4. A hand tool as stated in claim 1 wherein said second-mentioned means is a lever pivotally connected to said first-mentioned means intermediate the ends of said lever.

5. A hand tool as stated in claim 1 wherein said first-mentioned means is a pair of pliers, said second-mentioned means is a lever having a first end engageable with said second member and a second end defining a hand grip and wherein said third-mentioned means is a bracket having one end connected to said pliers and its other end pivotally connected to said lever intermediate the ends of said lever.

6. A hand tool as stated in claim 5 wherein said bracket is a U-shaped member having a bight portion and a pair of arms extending upwardly from said bight portion, said bight portion being connected to said pliers and said rod being mounted between said arms.

7. A hand tool as stated in claim 5 wherein said first end of said lever has a notch provided therein for straddling said elongated member.

8. A hand tool for adjusting caliper-type brakes including a pair of brake arms each having a first end biased away from engagement with a wheel and a second end, a yoke cable connected to said second ends, a cable clamp connected to said yoke cable and a cable-clamp bolt connecting said cable clamp to a brake-actuating cable having a free end extending beyond said cable clamp normal to the major axis of said yoke cable, said hand tool comprising:

means for gripping said free end of said brake-actuating cable in a plane normal thereto;

means for engaging said cable clamp to move it axially along said brake-actuating cable in a directon such that said yoke cable moves said second ends of said brake arms far enough to at least partially overcome said bias on said first ends of said brake arms for positioning said first ends an optimum distance from said wheel and to hold said brake-actuating cable and said cable clamp in adjusted position while said cable-clamp bolt is tightened; and means connecting said second-mentioned means to said first-mentioned means for movement in a plane normal to said first plane.

9. In a tool of the type which includes a first and second levers each having a first end defining a work-engaging portion and a second end defining a hand grip portion and means pivotally connecting said first and second levers together intermediate said ends, the improvement which comprises:

a third lever having a first end defining a work-engaging portion and a second end defining a grip portion; and means for pivotally connecting said third lever to said tool in a manner such that said work-engaging and said grip portions of said third lever overlie said work-engaging and said grip portions, respectively, of said first and second levers in a spaced relationship therewith and in a plane-of-rotation normal to the plane-of-rotation of said first and second levers, whereby a user of said tool may use one hand to simultaneously squeeze said work-engaging portions of said first and second levers together and swing said work-engaging portion of said third lever away from said work-engaging portions of said first and second levers.

10. An improvement as stated in claim 9 wherein said first and second levers define a pair of pliers, wherein said means pivotally connecting said first and second levers together is a bolt-and-nut assembly and wherein said means pivotally connecting said third lever to said tool comprises:

a U-shaped bracket having a bight portion and a pair of upstanding arms, said arms having upper free ends;

means connecting said bight portion to said bolt-and-nut assembly; and means pivotally connecting said third lever to said upper free ends of said arms between said arms.

* * * * *